United States Patent [19]

Perrin et al.

[11] 4,378,912

[45] Apr. 5, 1983

[54] SHEET MATERIAL DISPENSER APPARATUS

[75] Inventors: Jack L. Perrin, Los Angeles; Council A. Tucker, Glendale; Oliver B. Gains, Arcadia, all of Calif.

[73] Assignee: Crown Zellerbach Corporation, San Francisco, Calif.

[21] Appl. No.: 320,257

[22] Filed: Nov. 12, 1981

[51] Int. Cl.[3] ..... B65H 19/04; G03B 1/58

[52] U.S. Cl. ..... 242/55.3; 226/91; 242/55.53; 312/38

[58] Field of Search ..... 226/91; 242/55.3, 65, 242/66, 67.1 R, 55.53, 67.2; 312/37, 38, 39, 41

[56] References Cited

U.S. PATENT DOCUMENTS

| | | | |
|---|---|---|---|
| 2,930,664 | 3/1960 | Liebisch | 242/58 X |
| 2,974,839 | 3/1961 | Batlas et al. | 225/34 X |
| 3,007,650 | 11/1961 | Burton | 242/55.3 |
| 3,038,598 | 6/1962 | Layton et al. | 242/1 |
| 3,073,541 | 1/1963 | Layton et al. | 242/55.53 |
| 3,288,387 | 11/1966 | Craven, Jr. | 242/55.53 |
| 3,606,125 | 9/1971 | Tucker et al. | 226/130 |
| 3,628,743 | 12/1971 | Bastian et al. | 242/55.3 |
| 3,917,191 | 11/1975 | Graham, Jr. et al. | 226/11 X |
| 4,010,909 | 3/1977 | Bastian | 242/55.3 |
| 4,106,684 | 8/1978 | Hartbauer et al. | 226/91 |

*Primary Examiner*—Stuart S. Levy
*Assistant Examiner*—Scott J. Haugland
*Attorney, Agent, or Firm*—Thomas R. Lampe

[57] ABSTRACT

A device for sequentially dispensing sheet material from a primary roll and a reserve roll including rotatable dispensing rollers, at least one of the rollers having a groove therein, sensing means for entering the groove when sheet material from the primary roll is depleted and tucker means responsive to such movement to engage reserve roll sheet material and introduce it between the rotatable rollers.

4 Claims, 8 Drawing Figures

SHEET MATERIAL DISPENSER APPARATUS

BACKGROUND OF THE INVENTION

1. Field of Invention

This invention relates to apparatus for sequentially dispensing sheet material from a primary roll and a reserve roll.

2. Description of the Prior Art

The prior art sets forth a number of arrangements for dispensing paper towels and the like and includes a variety of mechanisms aimed at sequentially dispensing from a primary roll and one or more reserve rolls. Representative of prior art patents in this area are: U.S. Pat. No. 2,974,839, Batlas, et al., issued Mar. 14, 1961; U.S. Pat. No. 2,930,664, Liebisch, issued Mar. 29, 1960; U.S. Pat. No. 3,288,387, Craven, issued Nov. 29, 1966; U.S. Pat. No. 3,628,743, Bastian, issued Dec. 21, 1971; U.S. Pat. No. 3,917,191, Graham, Jr. et al., issued Nov. 4, 1975; U.S. Pat. No. 4,010,909, Bastian, issued Mar. 8, 1977; and U.S. Pat. No. 4,106,684, Hartbauer et al., issued Aug. 15, 1978.

It is an objective of all of the above-identified arrangements to transfer to a dispenser mechanism the sheet material of a reserve roll upon depletion or near depletion of a primary roll. This is also an objective of the present invention wherein the apparatus hereof is characterized by its simplicity, low cost and compactness, highly desirable features in mechanisms of this type. In addition, the apparatus is reliable in operation and effects transfer when only a miniscule amount of primary roll sheet material remains. This is important to prevent double dispensing resulting in sheet material waste. The present arrangement, due to its simplicity and compactness, may be readily retrofit to existing cabinets.

BRIEF SUMMARY OF THE INVENTION

The present invention relates to a dispenser cabinet for sequentially dispensing sheet material from a primary roll and a reserve roll. The cabinet has a plurality of selectively rotatable rollers, at least two of the rollers defining a nip for the dispensing of the sheet material and at least one of the rollers having a depression formed therein. Sensing means is disposed in registry with the depression and urged there-toward. The sensing means is engageable with sheet material being dispensed from the primary roll along a predetermined path between the sensing means and the depression and is prevented by the primary roll sheet material from entering the depression. Tucker means is responsive to the absence of the primary roll sheet material between the sensing means and depression and the subsequent entry of the sensing means into the depression to engage sheet material from the reserve roll and introduce the reserve roll sheet material into the nip.

DETAILED DESCRIPTION

Figure 1:
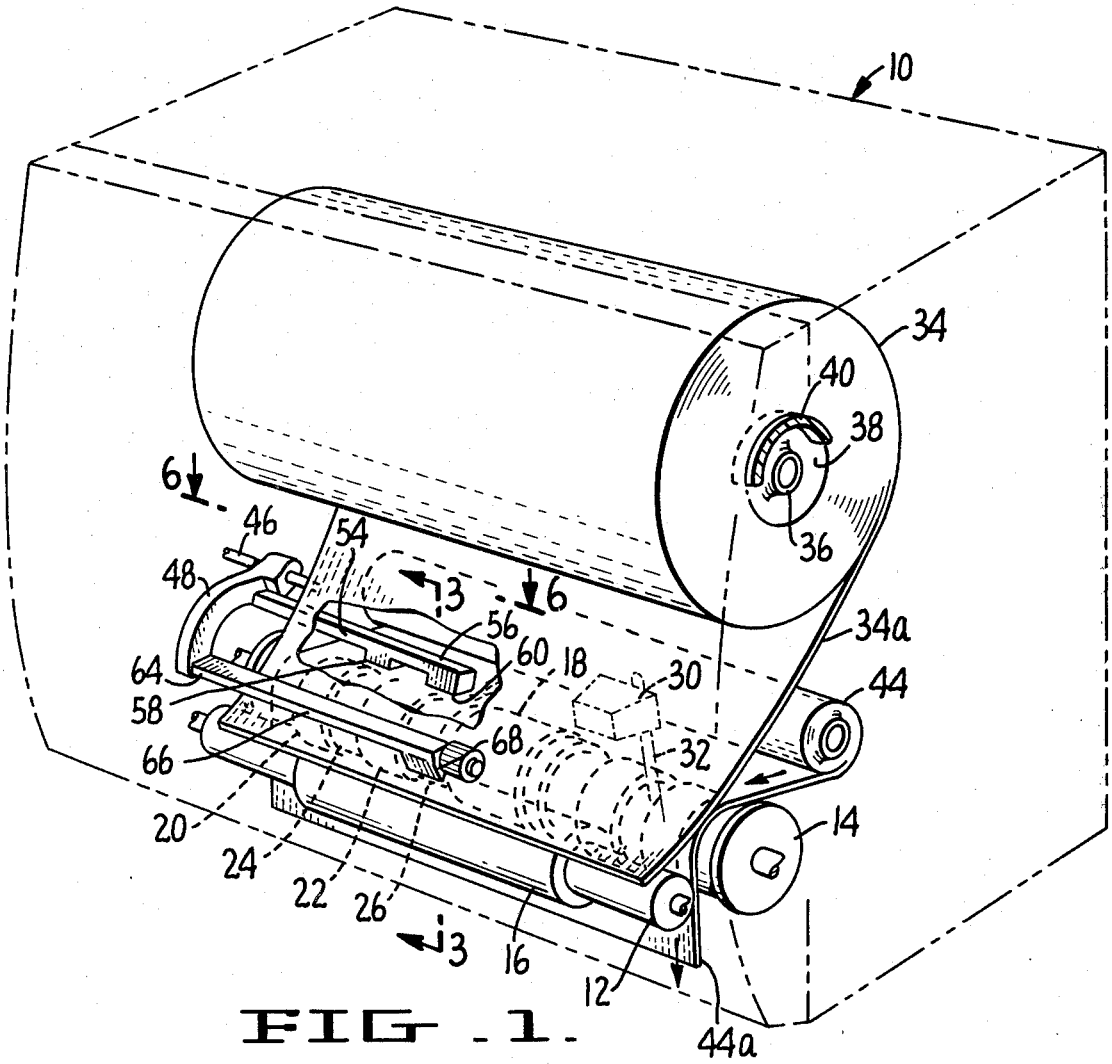
FIG. 1 is a perspective view of a device constructed in accordance with the teachings of the present invention, with the outer housing of the device being shown in phantom.
Figure 2:
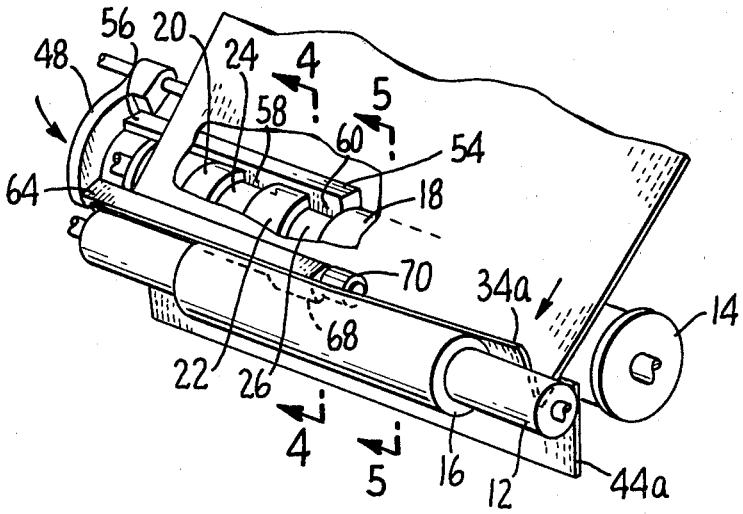
FIG. 2 is a perspective view showing operational details of the mechanism for effecting transfer from a primary roll to a reserve roll.

Referring now to FIG. 1, a device constructed in accordance with the teachings of the present invention is illustrated. The operating mechanism of the device is preferably suitably disposed in a cabinet housing which in FIG. 1 is designated by reference numeral 10 and is illustrated in phantom so that operating components of the invention may be clearly seen. The device includes sheet material feed means for dispensing sheet material from the cabinet, said sheet material feed means in the illustrated preferred embodiment being a pair of rollers 12 and 14 which are selectively rotatable and form a nip through which the sheet material is drawn upon rotation of the rollers in a well known manner. The rollers are journaled at the ends thereof in suitable sockets (not shown) disposed at the sides of the cabinet housing. A resilient sleeve 18 comprised of rubber or any other suitable resilient material is provided on drive roller 14 to improve the grip that the roller 14 applies to the sheet material upon rotation thereof. A centrally disposed sleeve 16 comprises an integral portion of idler roller 12. Smaller sleeves 20, 22 are disposed at the left of roller 14 as viewed in FIGS. 1 and 2, sleeves 20, 22 being separated from themselves and central sleeve 18 to provide depressions in the roller 14 in the form of grooves 24 and 26 about the periphery thereof. A similar arrangement may be provided on the right end of roller 14 as shown. It will be appreciated that sleeve 18 of roller 14 is in engagement with sleeve 16 of roller 12 to form the sheet material dispensing nip and effect rotation of idler roller 12.

Any suitable mechanism may be employed to effect rotation of drive roller 14. As a consequence, such mechanism has not been illustrated. One such suitable mechanism is described in U.S. Pat. No. 3,606,125 and reference may be had to that patent for details of a suitable mechanism for rotating sheet material feed means of the roller type. As will be noted with reference to that patent, incremental lengths of toweling are dispensed upon manual actuation of a handle projecting through a slot in the front of dispenser housing. Such a handle is illustrated in FIG. 1 in phantom and is designated by means of reference numeral 30. It will be appreciated that depression of the handle 30 by the operator will cause a corresponding rotation of rollers 12 and 14. The handle projects through a vertical slot 32 in the front of the cabinet, said slot guiding the movement of the handle and its associated structure and the lower limit thereof determining the extent to which the handle is depressed, and consequently the degree of rotation of drive roller 14 and idler roller 2. With each depression of the handle a substantially uniform incremental length of toweling will be dispensed.

Located within housing 10 is a roll of sheet material in the form of paper toweling 34, hereinafter referred to as the reserve roll. The particular roll 34 illustrated is of the type shown in U.S. Pat. No. 3,038,598, being wound about a core 36 and having a bearing receptacle 38 formed in one extremity of roll 34 by cutting away the paper adjacent to core 36 to define a bearing wall constituted of contiguous layers of the paper toweling forming the roll. A bearing member 40, of the type for example in U.S. Pat. No. 3,073,541, is mounted on the sidewall of the dispensing housing 10 and projects inwardly to bearing receptacle 38 to rotatably support the paper towel reserve roll at a predetermined location within housing 10. It will be appreciated that the other end of roll 34 is supported by a suitable bearing mechanism positioned at the other side ofthe housing. Such bearing has not been shown for purposes of simplification and reference may be had for the aforementioned U.S. Pat. No. 3,073,541 for a suitable structure of this type. It will be appreciated that the afore-described roll construction and support bearing construction will result in the automatic dismounting or displacement of the roll from its associated support bearings when enough paper toweling has been removed from the roll for the bearing receptacle 38 to disappear. The partial roll will then fall downwardly into the bottom area of the dispensing cabinet housing 10, thus enabling a new roll of toweling to be installed in operative relationship with bearing member 40. The roll which has fallen downwardly into the bottom area of the dispenser cabinet is illustrated in FIG. 1 and is identified by reference numeral 44. Roll 44 will hereinafter be referred to as the primary roll. As stated above, the objective of the present invention is to sequentially dispense sheet material from a primary roll and a reserve roll. It will be appreciated that the rolls may be of any type and may be supported in the cabinet housing 10 in any manner. For example, the rolls and cabinet housing need not incorporate the aforedescribed drop down feature. For example, both the primary roll and the reserve roll may each be rotatably mounted at a fixed location in the cabinet housing on suitable support means provided therein, as for example, support means of the general type illustrated in aforesaid U.S. Pat. No. 3,288,387.

Extending between the end walls of cabinet housing 10 is a rod 46 which is rotatably mounted with respect to the end walls in any desired fashion as by being disposed in sockets (not shown) in the end walls. Rod 46 passes through an aperture formed at one end of a curved support member 48 and is secured thereto by means of a set screw 50 as may perhaps best be seen with reference to FIGS. 3–5. Rigidly attached to support member 48 and extending generally parallel to rollers 12 and 14 is sensing means 54 in the form of an elongated member 56 having tabs or pads 58 and 60 projecting therefrom. It should be noted that tabs 58 and 60 are in alignment with depressions 24, 26 formed in roller 14.

Also fixedly attached to support 48 is a tucker means 64 in the form of an elongated member 66 having a pointed tucker blade 68 attached thereto. Elongated member 66 is substantially parallel to elongated member 56 and thus also substantially parallel to rollers 12 and 14. Journaled at the extreme end of elongated member 66 is a rotatable member 70.

Figure 3:
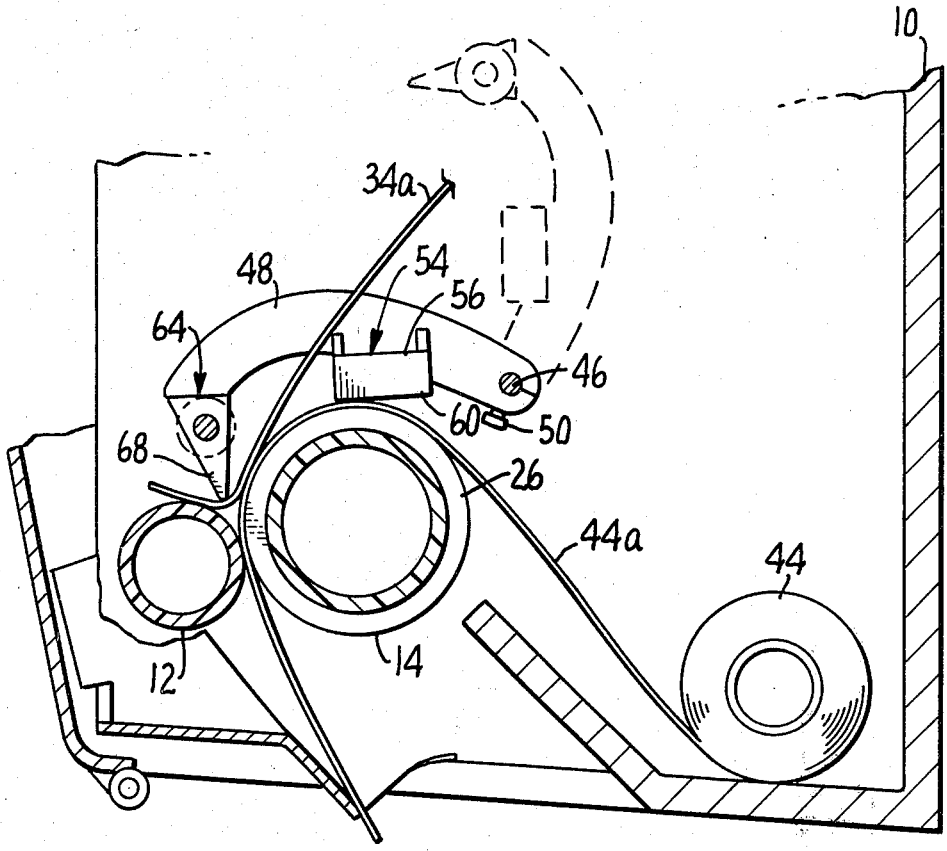
FIG. 3 is a sectional view taken along line 3—3 of FIG. 1.
Figure 4:
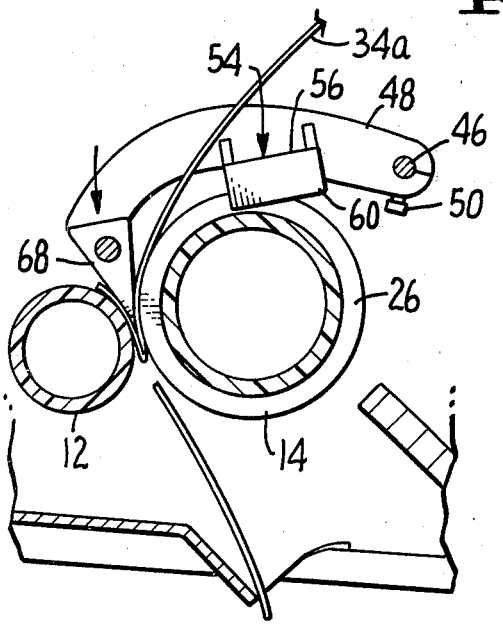
FIG. 4 is a sectional view taken along line 4—4 of FIG. 2.
Figure 5:
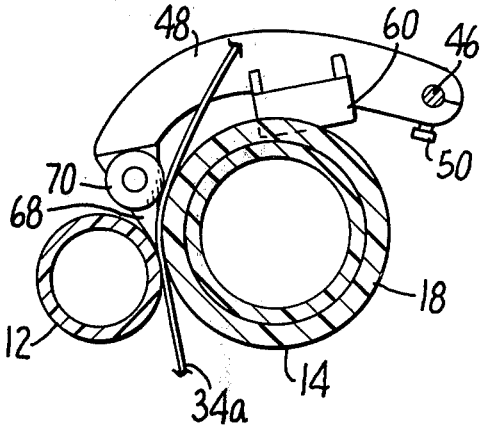
FIG. 5 is a sectional view taken along line 5—5 of FIG. 2.

The operation of the aforesaid device is as follows. As may perhaps best be seen with reference to FIG. 3 paper toweling **44*a* being dispensed from primary roll 44 passes about the periphery of roller 14 and thence through the nip formed thereby with roller 12. The toweling then passes through a slot from the bottom of the cabinet housing. Under the influence of gravity support member 48 as well as the sensing means 54 and tucker means 64 will be continuously urged in a counter clockwise direction so that tabs 58 and 60 of the sensing means will engage toweling 44*a* and be prevented thereby from entering grooves 24 and 26. Prior to web transfer toweling 34*a* from the reserve roll 34 will have been placed as shown in FIG. 3 with the end thereof positioned under tucker blade 68. As primary roll 44 is depleted and the tail end thereof passes over roller 14 tabs 58 and 60 will be free to drop into grooves 24 and 26 as shown in FIG. 4. This action, in turn, will cause the tucker blade 68 to engage toweling 34*a* at the end of the reverse roll and cause same to enter the nip formed between rollers 12 and 14. Thus, a new paper roll will be started through the dispensing mechanism substantially simultaneously with the termination of toweling from the primary roll as shown in FIG. 5. Rotatable member 70 engages sleeve 18 of roller 14 to restrain the tucker blade 68** itself from contacting the sleeve and entering completely into the nip to jam the mechanism.

Figure 6:
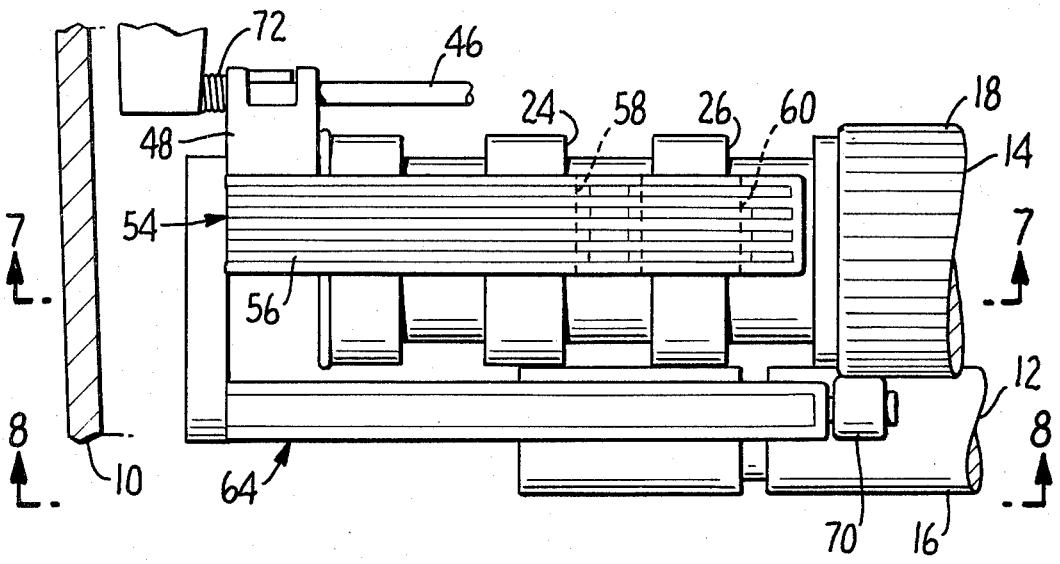
FIG. 6 is a sectional view taken along line 6—6 of FIG. 1.
Figure 7:
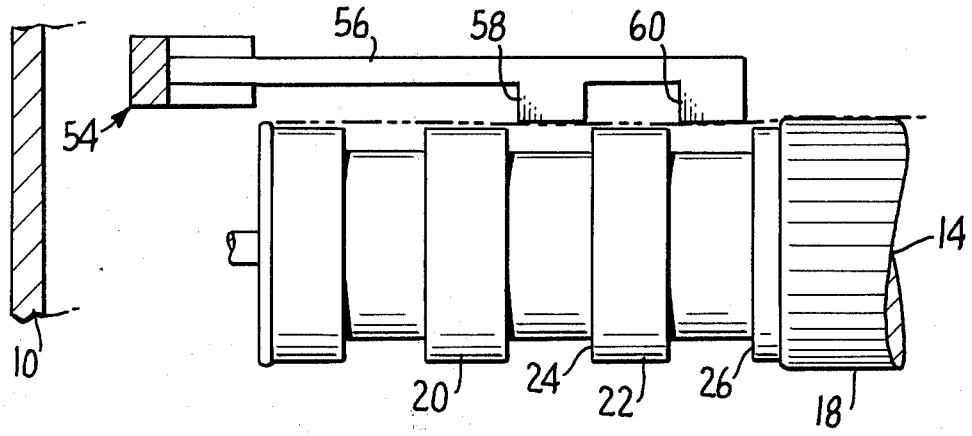
FIG. 7 is a sectional view taken along line 7—7 of FIG. 6.
Figure 8:
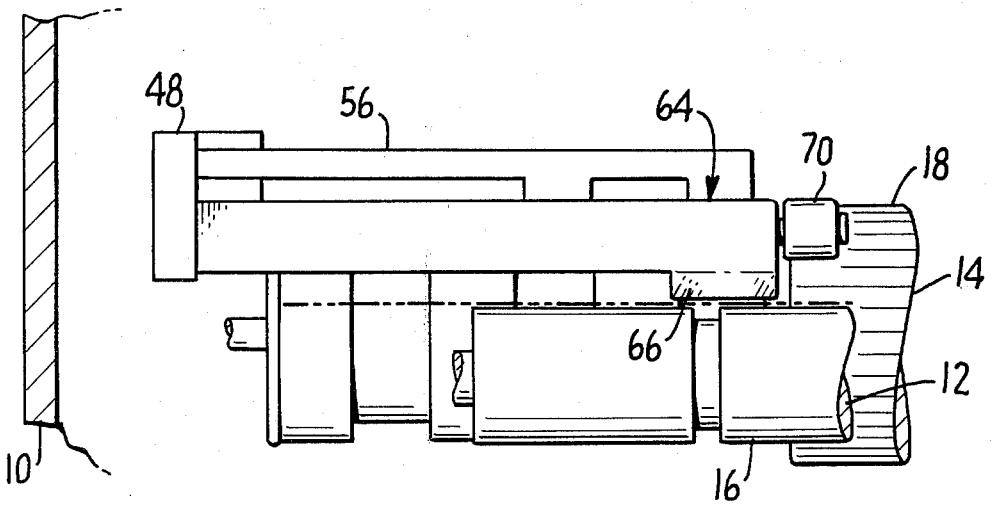
FIG. 8 is a sectional view taken along line 8—8 of FIG. 6.

It will be appreciated that proper placement of the sensing means and tucker means relative to roller 14, and in particular the grooves thereof, is important to the aforedescribed device. To permit ready adjustment of such placement set screw 50 may be loosened and curved support member 48 slid to the desired position along rod 46 and the set screw is then retightened. A coil compression spring 72 (FIG. 6) will force both the rod 46 and the mechanism depending therefrom toward the right end wall of the cabinet housing as viewed in FIG. 6 thus the rod 46 will be unable to shift back and forth between the ends of the housing despite differences in cabinet housing dimensions that may occur.

We claim:

1. In a dispenser cabinet for sequentially dispensing sheet material from a primary roll and a reserve roll, the improvement comprising:

a plurality of selectively rotatable rollers, at least two of said rollers defining a nip and at least one of said rollers having at least one depression formed therein;

sensing means in registry with said depression and urged theretoward, said sensing means engageable with sheet material being dispensed from said primary roll along a predetermined path between the sensing means and depression and prevented by said primary roll sheet material from entering said depression;

tucker means for engaging sheet material from said reserve roll and introducing said reserve roll sheet material into said nip responsive to the absence of said primary roll sheet material between the sensing means and depression and to the subsequent entry of said sensing means into said depression; and mounting means, said sensing means and said tucker means being mounted for joint pivotal movement about said mounting means.

2. The improvement of claim 1 wherein said sensing means and said tucker means comprise at least a portion of a unitary structure.

3. The improvement of claim 1 wherein said sensing means and said tucker means each comprise elongated members spaced from one another and extending substantially parallel to said rotatable rollers.

4. The improvement of claim 3 wherein the sensing means elongated member has a tab projecting therefrom for positioning in said depression upon the absence of said primary roll sheet material between the sensing means and said depression.

* * * * *